US006748604B2

(12) United States Patent
Duboff et al.

(10) Patent No.: US 6,748,604 B2
(45) Date of Patent: Jun. 15, 2004

(54) GLOVE MASSAGER

(75) Inventors: Caryn K. Duboff, Bay Harbor Islands, FL (US); Frank J. Reich, Hollywood, FL (US); Howard R. Broad, North Miami Beach, FL (US)

(73) Assignee: Finger Fitting Products, Inc., Bay Harbor Islands, FL (US)

( * ) Notice: Subject to any disclaimer, the term of this patent is extended or adjusted under 35 U.S.C. 154(b) by 0 days.

(21) Appl. No.: 10/158,386

(22) Filed: May 30, 2002

(65) Prior Publication Data

US 2003/0221238 A1 Dec. 4, 2003

(51) Int. Cl.[7] ..... A41D 19/00
(52) U.S. Cl. ..... 2/160; 2/161.6
(58) Field of Search ..... 2/160, 161.6, 16, 2/163; 15/227; 119/600; 601/40, 46, 70–74, 78–80

(56) References Cited

U.S. PATENT DOCUMENTS

| | | | |
|---|---|---|---|
| 1,498,680 | A | 6/1924 | Clement et al. |
| 2,181,282 | A | 11/1939 | Oster |
| 2,286,089 | A | 6/1942 | Harris |
| 2,287,501 | A | 6/1942 | Thomas |
| 2,350,817 | A | 6/1944 | Purves et al. |
| 2,562,418 | A | 7/1951 | Enrico et al. |
| 2,644,446 | A | 7/1953 | Viniegra |
| 2,686,325 | A | 8/1954 | Silver |
| 2,918,055 | A | 12/1959 | Boerger |
| 3,149,629 | A | 9/1964 | Katz |
| 3,461,859 | A | 8/1969 | Fortnam |
| 3,623,064 | A | 11/1971 | Kagan |
| 3,623,481 | A | 11/1971 | Curran |
| 3,841,321 | A | 10/1974 | Albach et al. |
| 3,875,488 | A | 4/1975 | Crocker et al. |
| 3,911,416 | A | 10/1975 | Feder |
| 4,030,208 | A | 6/1977 | Carver et al. |
| 4,115,755 | A | 9/1978 | Cotton |
| 4,116,233 | A | 9/1978 | Scaduto |
| 4,148,014 | A | 4/1979 | Burson |
| 4,149,530 | A | 4/1979 | Gow |
| 4,262,549 | A | 4/1981 | Schwellenbach |
| 4,308,860 | A | 1/1982 | Sanders et al. |
| 4,333,070 | A | 6/1982 | Barnes |
| 4,398,889 | A | 8/1983 | Lam et al. |

(List continued on next page.)

FOREIGN PATENT DOCUMENTS

| | | |
|---|---|---|
| EP | 0 265 011 B1 | 1/1991 |
| EP | 0 585 470 A1 | 3/1994 |
| EP | 0 626 634 A2 | 11/1994 |
| FR | 937.934 | 5/1954 |
| WO | WO 91/11775 A1 | 8/1991 |
| WO | WO 95/32459 A1 | 11/1995 |

OTHER PUBLICATIONS

Copies of packaging from "Fuzuoku™ Power Pack," manufactured by Finger–Fitting Products, Inc., and copies of the product as shown on the manufacturer's website: www.fingerfittingproducts.com.
Packaging from "VibraTouch," manufactured by IdeaPlanet.net.
Packaging from "Micro finger Tingler," manufactured by California Exotic Novelties.
Packaging from "Fukuoku Power Pack," manufactured by Finger–Fitting Products, Inc.
Packaging from "Fukuoku 9000," manufactured by Finger–Fitting Products, Inc.

*Primary Examiner*—Katherine Moran
(74) *Attorney, Agent, or Firm*—Wallenstein Wagner & Rockey, Ltd.

(57) ABSTRACT

A glove which includes massage elements within each of the fingertips of the glove. Each massage element includes a housing and a motor therein for vibrating the housing. A power source, such as a conventional or rechargeable battery, may be provided for powering the motors. Each massage element is electronically connected to the power source. A securing means may be provided for securing the device to the hand of a user.

9 Claims, 2 Drawing Sheets

U.S. PATENT DOCUMENTS 4,436,188 A 3/1984 Jones
4,464,117 A 8/1984 Foerst
4,535,482 A * 8/1985 Spector et al. ..... 2/160
4,550,358 A 10/1985 Crowley et al.
4,577,626 A 3/1986 Marukawa et al.
4,712,101 A 12/1987 Culver
4,731,603 A 3/1988 McRae et al.
4,732,142 A 3/1988 Hurlburt et al.
4,768,681 A * 9/1988 Dean et al. ..... 222/79
4,769,763 A 9/1988 Trieb et al.
4,782,327 A 11/1988 Kley et al.
4,794,384 A 12/1988 Jackson
4,825,853 A 5/1989 Iwamoto et al.
4,839,838 A 6/1989 LaBiche et al.
4,857,881 A 8/1989 Hayes
4,874,998 A 10/1989 Hollis, Jr.
4,879,556 A 11/1989 Duimel
4,896,554 A 1/1990 Culver
4,961,138 A 10/1990 Gorniak
D311,955 S 11/1990 Lie
5,007,300 A 4/1991 Siva
5,022,384 A 6/1991 Freels et al.
5,059,150 A 10/1991 Kuo
5,070,862 A 12/1991 Berlant
5,072,361 A 12/1991 Davis et al.
5,143,505 A 9/1992 Burdea et al.
5,165,897 A 11/1992 Johnson
5,175,459 A 12/1992 Danial et al.
5,184,319 A 2/1993 Kramer
5,189,355 A 2/1993 Larkins et al.
5,197,003 A 3/1993 Moncrief et al.
5,203,563 A 4/1993 Loper, III
5,204,600 A 4/1993 Kahkoska
5,212,473 A 5/1993 Louis
5,228,356 A 7/1993 Chuang
5,264,768 A 11/1993 Gregory et al.
5,275,565 A 1/1994 Moncrief
5,280,265 A 1/1994 Kramer et al.
5,283,970 A 2/1994 Aigner
5,296,846 A 3/1994 Ledley
5,296,871 A 3/1994 Paley
5,309,140 A 5/1994 Everett, Jr. et al.
5,313,230 A 5/1994 Venolia et al.
5,327,790 A 7/1994 Levin et al.
5,354,162 A 10/1994 Burdea et al.
5,355,148 A 10/1994 Anderson
5,379,663 A 1/1995 Hara
5,388,992 A 2/1995 Franklin et al.
5,389,865 A 2/1995 Jacobus et al.
5,396,267 A 3/1995 Bouton
5,399,091 A 3/1995 Mitsumoto
5,429,140 A 7/1995 Burdea et al.
5,436,622 A 7/1995 Gutman et al.
5,437,607 A 8/1995 Taylor
5,437,608 A 8/1995 Cutler
5,451,924 A 9/1995 Massimino et al.
5,459,382 A 10/1995 Jacobus et al.
5,473,235 A 12/1995 Lance et al.
5,506,605 A 4/1996 Paley
5,519,292 A 5/1996 Taylor et al.
5,541,831 A 7/1996 Thomas
5,547,382 A 8/1996 Yamasaki et al.
5,565,840 A 10/1996 Thorner et al.
5,575,761 A 11/1996 Hajianpour
5,589,854 A 12/1996 Tsai
5,601,529 A * 2/1997 Wollman ..... 601/74
5,643,087 A 7/1997 Marcus et al.
5,656,901 A 8/1997 Kurita
5,669,818 A 9/1997 Thorner et al.
5,684,722 A 11/1997 Thorner et al.
5,709,219 A 1/1998 Chen et al.
5,736,978 A 4/1998 Hasser et al.
5,742,278 A 4/1998 Chen et al.
5,768,709 A * 6/1998 Newkirk et al. ..... 2/160
5,816,823 A 10/1998 Naimark et al.
5,986,643 A 11/1999 Harvill et al.
6,109,214 A * 8/2000 Rampersad ..... 119/600
6,160,489 A 12/2000 Perry et al.
6,203,509 B1 * 3/2001 Duboff ..... 601/70
6,401,252 B1 * 6/2002 Dean ..... 2/160
6,505,349 B1 * 1/2003 Logan et al. ..... 2/158

* cited by examiner

GLOVE MASSAGER

TECHNICAL FIELD

The invention is directed to a massager, and particularly to a glove massager that is worn by a user and that includes a plurality of massage elements, such that each finger of the glove has a massage element attached thereto, to allow a user to enhance a given massage with vibrations.

BACKGROUND OF THE INVENTION

The invention is an improvement upon battery-powered massaging devices. Available massaging devices attach to individual fingers or are hand-held, requiring the respective users to contend with holding the device rather than focusing on the intended massage. The following are some examples of existing massaging devices.

U.S. Pat. No. 6,203,509 is directed to a finger massage device that is mountable to a user's finger. U.S. Pat. No. 6,203,509 issued from application Ser. No. 09/060,595, and is hereby incorporated by reference into the present application. U.S. Pat. Nos. 5,601,529 and 5,519,292 are both directed to massage apparatuses that are mountable on the hand and wrist of the user. U.S. Pat. No. 4,116,233 is directed to a large fixed massage ball, and is mountable to all of the fingers of one hand. U.S. Pat. No. 3,623,481 is directed to a gum massage implement that is mounted to the posterior side of a finger of the user, and a method of finger massaging gums. U.S. Pat. Nos. 2,918,055 and 2,350,817 are both directed to hand massagers. Both of the devices depicted in these patents are secured to the posterior side of several fingers of the user. These devices also impart vibratory forces to the hand of the user, which is in turn used for massaging either the user or another. U.S. Pat. No. 2,286,089 is directed to a hand attachment means for a vibrator. The reference from the French Ministry of Industry and Commerce (Ministere de L'Industrie et du Commerce), number 59.368, describes a massage glove. The device utilizes hot air to heat the glove, and the massaging vibrations imparted by the glove are caused by a piston mechanism pushing pulsations of hot air through the glove.

The above examples have numerous deficiencies and problems. The present invention is directed to solving these and other problems.

SUMMARY OF THE INVENTION

The invention is a glove massager for securing to a hand of a user. The glove massager comprises a casing having an anterior side and a posterior side. The casing may be a glove having a plurality of fingers, with each finger having a distal portion and a proximal portion. A power source securing means can be included, as can a power source removably contained within the power source securing means. An electrical circuit electrically connects the power source to a plurality of massage elements. Each massage element is attached to the anterior side of the distal portion of one of the fingers such that each finger has at least one massage element. A fastening means for securing the glove to a user's hand can be provided.

The power source securing means can be water resistant, and can be located within the casing or on the anterior or posterior side of the casing. The power source means can include a control means for controlling vibration speed. In a preferred embodiment, each massage element creates approximately 9,000 vibrations per minute when the control means is set at full speed.

Each massage element has a housing and a motor therein for vibrating the housing. These housings can be water resistant, and can be removably attached to the anterior side of the distal portion of the fingers of the casing. Each massage element housing has an anterior surface and a posterior surface. The anterior surface may be a convex surface substantially similar in shape to the distal anterior portion of a human fingertip. The posterior surface can be a concave surface adapted to fit a distal anterior portion of the user's finger.

Other features and advantages will become apparent with reference to the Drawings and Detailed Description below.

DETAILED DESCRIPTION OF THE PREFERRED EMBODIMENT

Figure 1:
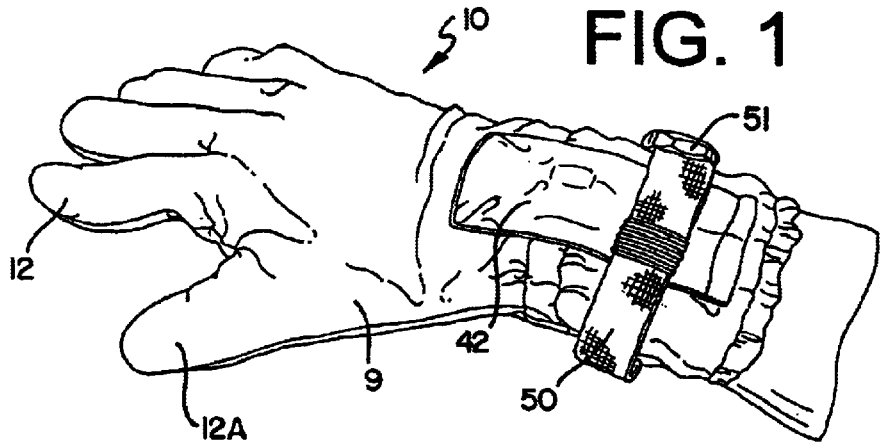
FIG. 1 is a lateral, posterior perspective view of one embodiment of the present invention, with a wrist strap mechanism for securing the device to the hand and wrist of a user.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The invention is shown generally in the FIGS. 1 through 5. As may be seen in the FIGS., a casing 9 such as a glove 10 is adapted to house massage elements 20, a power source 40, and an electrical circuit 30.

Figure 2:
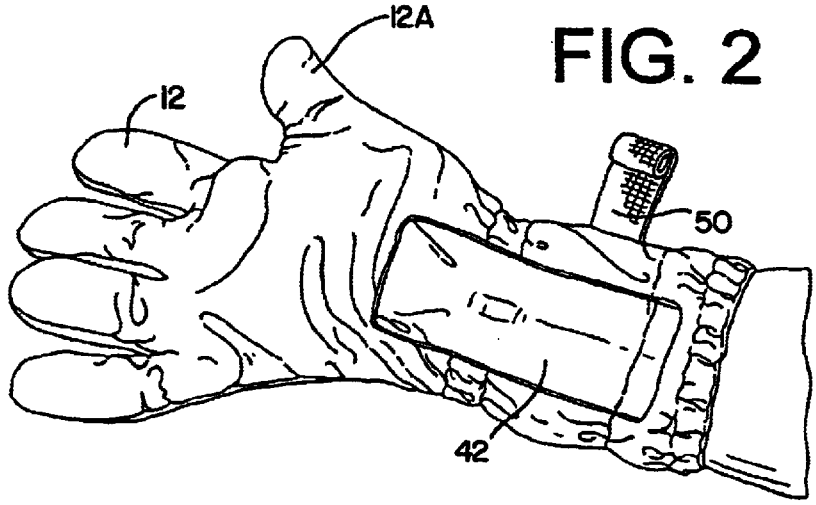
FIG. 2 is a view of the device from FIG. 1, but showing a medial, anterior perspective view, with the wrist strap shown in FIG. 1 depicted unbuckled, and showing a power source securing means on the proximal, anterior portion of the device.
Figure 3:
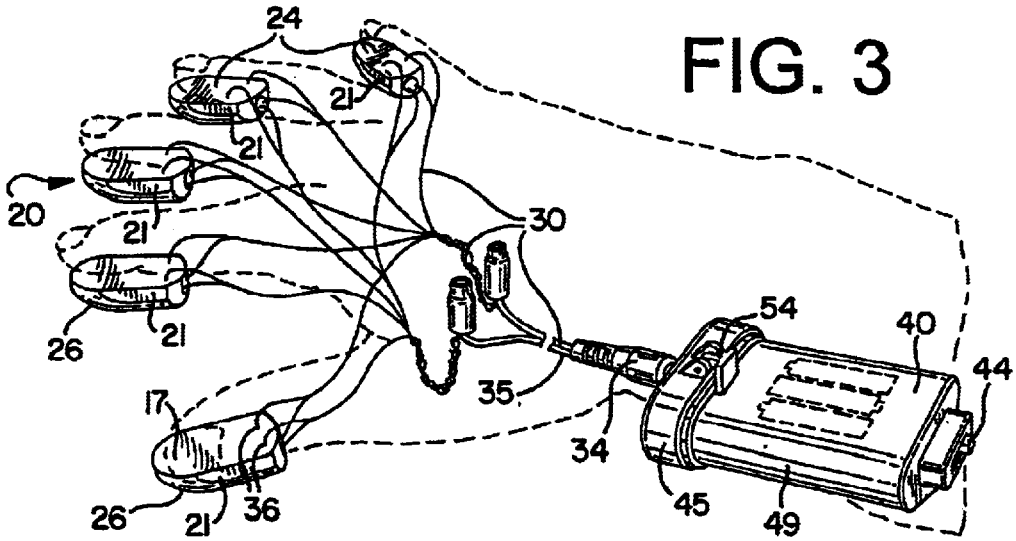
FIG. 3 is a schematic representation of the electrical elements of the device from FIG. 1, showing a plurality of massage elements and their respective positions relative to the hand of a user, and an electrical circuit connecting a power source to each of the respective massage elements.
Figure 4:
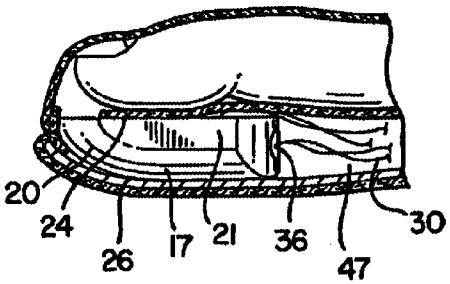
FIG. 4 is a longitudinal section of the distal end of a finger of the device in FIG. 1 showing a finger of a user inside the device, the location of an exemplary massage element relative to the finger of the user; and, FIG. 5 is a longitudinal section of the proximal portion of the device in FIG. 1, showing one potential location of a power source securing means, an example of a power source, and an electrical circuit means within a chamber located on the anterior side of the device.
Figure 5:
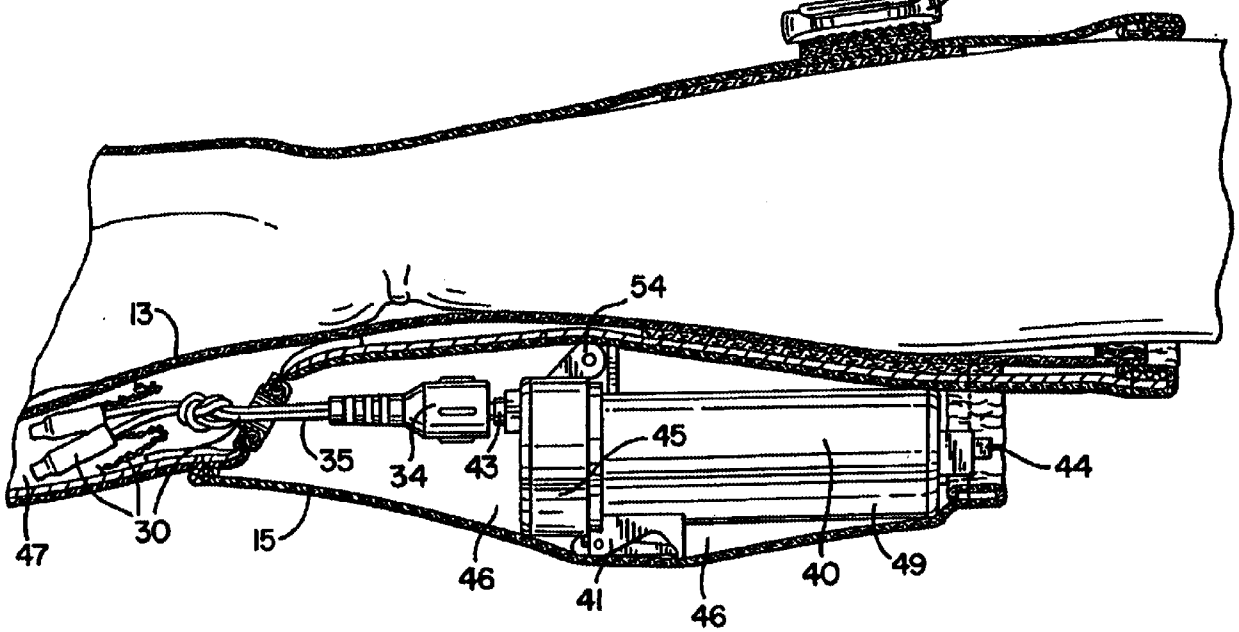

The casing 9 has an anterior side, shown generally in FIG. 2, and a posterior side, shown generally in FIG. 1. The casing 9 may be a glove 10 having a plurality of fingers 12, including one finger 12A adapted to fit over the thumb of a user. Each finger has a distal portion and a proximal portion. The glove 10 further comprises an inner shell 13 and an outer shell 15 which when coupled together form a cavity 47 within which the massage elements 20 and the electrical circuit 30 are contained. It will be further appreciated that the casing may be a mitten or any device that would substantially cover a hand.

A power source securing means 42 is included in the embodiment depicted in FIGS. 1 through 5. The power source securing means 42 secures the power source 40 proximate to the glove. The power source securing means 42 may be located within the glove 10 or external the glove 10. Furthermore, the power source securing means 42 may be located on the anterior or posterior side of the glove 10. Preferably, the power source securing means 42 is a pocket 46 located on the anterior side of the glove exterior.

The power source 40 is water resistant and removably contained within the power source securing means 42. The power source 40 has a proximal end and a distal end, the distal end having a female electrical connector 43. The power source 40 is preferably a battery pack having a cover 45 attached to a housing 49 by a hinge 54. The power source also includes a release mechanism 41 for opening the housing 49. The release mechanism 41 is preferably a spring-loaded lever.

The power source 40 further comprises a control means 44 such as a switch for controlling the vibration intensity of the massaging element 20. The power source 40 is coupled to the electric circuit 30, as described hereinafter, to provide power to the motor in the massaging element. The power source 40 is depicted as having a control means 44 for controlling vibration intensity.

An electrical circuit 30 located in the cavity 47 has a proximal end 35 and a distal end 36. The proximal end 35 of the electric circuit 30 has a male electrical connector 34 removably connected to the female electrical connector 43 located on the power source 40. The distal end 36 of the electrical circuit is electrically connected, as known to one ordinarily skilled in the art, to each individual massage element 20. Alternatively, the female electrical connector 43 can be located on the proximal end of the electrical circuit 30 and the male electrical connector 34 located on the distal end of the power source means 40.

Each individual massage element 20 is attached to the anterior side of the distal portion of one of the fingers (i.e., a fingertip Portion) such that each finger has at least one massage element. A massaging element 20 may furthermore be located proximate to the palm. The massaging elements 20 are located in the cavity 47 between the inner shell 13 and the outer shell 15. Each massage element 20 is electrically connected to the distal end 36 of the electrical circuit 30, and each massage element 20 has a housing 17 and a motor 21 therein for vibrating the housing thereby providing a massaging sensation to a massaging surface. The massaging surface may be the user's fingers, any surface on the user, or a surface not on the user, such a second user.

The housing 17 of the massaging elements 20 has a lower housing shell 24 and an upper housing shell 26. The upper housing shell may be a convex surface substantially similar in shape to the distal anterior portion of a human fingertip. The lower housing shell 24 may be similar in shape to the distal anterior portion of the human fingertip. The lower housing shell may be a concave surface adapted to fit the distal anterior portion of a human fingertip. Each massaging element 20 is water resistant.

A plurality of motors 21 are disposed in the housings 17 of the massaging elements 20 for vibrating the housings 17. For example, a first motor may be located in any one of the five housings 17 shown, and a second motor may be located in any other of the five housings 17 shown. Preferably, the motors 21 are DC current motors powered by the power source 40, typically in the form of a battery.

The glove massager may have a fastener 51 for securing the glove to a user's wrist or arm. A strap 50 extends substantially perpendicular to the longitudinal axis of the glove 10. Preferably, a fastener 51 is used with the strap 50 to secure the glove 10 to the user's wrist or arm. It is understood that conventional fastening means can be employed such as one or more snaps, a hook and loop fastener, buttons, or zippers.

While the specific embodiments have been illustrated and described, numerous modifications come to mind without significantly departing from the spirit of the invention and the scope of protection is only limited by the scope of the accompanying Claims.

We claim:

1. A massager comprising:

a glove including a palm panel, a back panel, and an inner shell, the inner shell and the palm panel forming a cavity on a palm side of the glove, the glove including a plurality of finger portions, the plurality of finger portions including a first fingertip portion and a second fingertip portion;

a first massage element located inside the cavity at the first fingertip portion, the first massage element including a first motor;

a second massage element located inside the cavity at the second fingertip portion, the second massage element including a second motor;

a power source; and a wire assembly connecting the first motor and the second motor to the power source, the wire assembly being located inside the cavity.

2. A massager as defined in claim 1, wherein the first massage element includes a concave surface and a convex surface, the concave surface being shaped to fit a human fingertip.

3. A massager as defined in claim 1, wherein the wire assembly removably connects the first motor and the second motor to the power source.

4. A massager as defined in claim 1, wherein the power source includes a controller for controlling a vibration speed associated with the first motor and the second motor.

5. A massager as defined in claim 1, wherein the power source includes a cover hingedly attached to a body and a release mechanism.

6. A massager as defined in claim 5, wherein the release mechanism comprises a spring-loaded lever.

7. A massager as defined in claim 1, wherein the glove includes a fastener to secure the glove to a user's hand.

8. A massager as defined in claim 1, wherein the first massage element is water-resistant.

9. massager as defined in claim 1, wherein the power source is water-resistant.

* * * * *